US006656669B2

(12) United States Patent
Ishida

(10) Patent No.: US 6,656,669 B2
(45) Date of Patent: Dec. 2, 2003

(54) BLEACH-FIXING COMPOSITION FOR A COLOR PHOTOGRAPHIC PROCESSING SYSTEM USED FOR SILVER HALIDE LIGHT-SENSITIVE PHOTOGRAPHIC MATERIAL AND PROCESSING METHOD USING THE SAME

(75) Inventor: Kenji Ishida, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/235,512

(22) Filed: Sep. 5, 2002

(65) Prior Publication Data

US 2003/0118956 A1 Jun. 26, 2003

(30) Foreign Application Priority Data

Sep. 12, 2001 (JP) ..... 2001-276059

(51) Int. Cl.[7] ..... G03C 7/42
(52) U.S. Cl. ..... 430/460
(58) Field of Search ..... 430/460

(56) References Cited

U.S. PATENT DOCUMENTS 5,580,705 A * 12/1996 Ueda et al. ..... 430/400
5,635,341 A * 6/1997 Yamashita et al. ..... 430/393
5,679,501 A * 10/1997 Seki et al. ..... 430/393
5,695,915 A * 12/1997 Ueda et al. ..... 430/393
5,885,757 A * 3/1999 Inaba et al. ..... 430/430
6,582,893 B2 * 6/2003 Vincent et al. ..... 430/460

* cited by examiner

*Primary Examiner*—Hoa Van Le
(74) *Attorney, Agent, or Firm*—Frishauf, Holtz, Goodman & Chick, P.C.

(57) ABSTRACT

A photographic bleach-fixing composition for a color photographic processing system in which bleach-fixing is carried out in a bleach-fixing bath that is replenished with a replenishing solution, wherein the photographic bleach-fixing composition comprises:

(a) a Fe(III) complex of a compound represented by Formula (I);

Formula (I)

, wherein each $A^1$, $A^2$, $A^3$ and $A^4$ represents independently —$CH_2OH$, —$PO_3M_2$ or —COOM, in which M represents a hydrogen atom or a monovalent cation; and X represents an alkylene group with 2 to 6 carbon atoms or —$(B^1O)_n$—$B^2$—, in which each $B^1$ and $B^2$ represents independently an alkylene group with 1 to 8 carbon atoms, and n represents an integer of 1 to 8, and (b) Fe(III) complex of ethylenediaminetetraacetic acid or Fe(III) complex of diethylenetriaminepentaacetic acid, provided that the mol concentration of (a) and (b) being A and B respectively satisfy the following formula:

$0.9<A/B<5.0$.

8 Claims, No Drawings

BLEACH-FIXING COMPOSITION FOR A COLOR PHOTOGRAPHIC PROCESSING SYSTEM USED FOR SILVER HALIDE LIGHT-SENSITIVE PHOTOGRAPHIC MATERIAL AND PROCESSING METHOD USING THE SAME

FIELD OF THE INVENTION

The present invention relates to a processing method of a silver halide light-sensitive color photographic material (hereinafter occasionally referred to as a light-sensitive material) and more specifically to a processing method of a light-sensitive material, which results in quick bleaching, as well as excellent storage stability of processing solutions and minimizes photographic effluent.

BACKGROUND OF THE INVENTION

At present, in the processing of light-sensitive materials, in order to bleach silver images, methods are proposed in which aminopolycarboxylic acid metal complexes are employed in a bleach bath as well as in a bleach-fixing composition (or bleach-fixer) as a bleaching agent. Listed as examples of the aminopolycarboxylic acid metal complexes are an (ethylenediaminetetraacetato)Fe(III) complex and a (1,3-propylenediaminetetraacetato)Fe(III) complex.

Further, in order to simplify processing steps as well as to carry out quick processing, an (ethylenediaminetetraacetato) Fe(III) complex is frequently employed as a bleaching agent in a bleach-fixing process which carries out both bleaching and fixing in one bath.

In a bleach-fixing bath, bleaching agents as an oxidizing agent and fixing agents (being thiosulfate ions) as a reducing component coexist. As a result, a phenomenon occurs in which thiosulfate ions are decomposed to sulfur ions while oxidized by the bleaching agent. Accordingly, sulfite ions as a preserving agent are added to the bleach-fixer so as to minimize oxidation of the thiosulfate ions. However, when the (ethylenediaminetetraacetato)Fe(III) complex is used in the bleach-fixer, the problems described below occur. In the (ethylenediaminetetraacetato)Fe(III) complex, divalent iron is very readily oxidized to trivalent iron (ferric iron). As a result, in the bleach-fixer, the valance of iron is always maintained to be trivalent, and sulfite ions as a preserving agent are subjected to continuous decomposition. As a result, oxidation of thiosulfate ions is enhanced, whereby the resultant storage stability of the bleach-fixer is degraded.

As methods to overcome the problem, Japanese Patent Publication Open to Public Inspection Nos. 59-149358, 59-151154, and 59-166977 disclose techniques using a (diethylenetriaminetetraacetato)Fe(III) complex.

It has been proven that these techniques result in excellent storage stability of the bleach-fixer compared to one employing the (ethylenediaminetetraacetato)Fe(III) complex. However, when color paper is processed employing the (diethylenetriaminetetraacetato)Fe(III) complex, problems occur such that when the resultant prints are stored at high temperature and high humidity, yellow stains form.

Further, Japanese Patent Publication Open to Public Inspection No. 5-181242 discloses a technique which employs succinic acid diamine type aminopolycarboxylic acid (EDDS).

However, when a bleach-fixer was prepared, based on the disclosed technique, it was found the resultant bleach-fixer did not result in sufficient oxidizing capability. Accordingly, it became essential to use the bleach-fixer at a relatively high concentration. As a result, it was found that the aminopolycarboxylic acid metal complex deposited at the surface of the processing solution, whereby the resultant deposits caused problems such as adhesion of the deposits onto prints and poor tracking of the automatic processor.

These problems are more pronounced during rapid processing as well as during low-replenished processing.

SUMMARY OF THE INVENTION

An object of the present invention is to provide a bleach-fixing composition (bleach-fixer) for light-sensitive materials, which rapidly bleaches silver, minimizes deposits at the surface of the bleach-fixer and also minimizes formation of yellow stains on images during storage, and a processing method employing the same.

The aforesaid object of the present invention is achieved employing the processing method described below.

1. A photographic bleach-fixing composition for a color photographic processing system in which bleach-fixing is carried out in a bleach-fixing bath that is replenished with a replenishing solution, wherein the photographic bleach-fixing composition comprises:

(a) a Fe(III) complex of a compound represented by Formula (I);

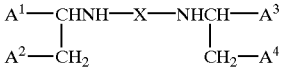

Formula (I)

wherein each $A^1$, $A^2$, $A^3$ and $A^4$ represents independently —$CH_2OH$, —$PO_3M_2$ or —COOM, in which M represents a hydrogen atom or a monovalent cation; and X represents an alkylene group with 2 to 6 carbon atoms or —$(B^1O)_n$—$B^2$—, in which each $B^1$ and $B^2$ represents independently an alkylene group with 1 to 8 carbon atoms, and n represents an integer of 1 to 8, and (b) Fe(III) complex of ethylenediaminetetraacetic acid or Fe(III) complex of diethylenetriaminepentaacetic acid, provided that the mol concentration of (a) and (b) being A and B respectively satisfy the following formula:

$$0.9<A/B<5.0.$$

2. The photographic bleach-fixing composition of item 1, further comprising an organic carboxylic acid.
3. The photographic bleach-fixing composition of item 2, wherein the organic carboxylic acid is represented by Formula (C):

$$A_9\text{-}(COOM)_n \qquad \text{Formula (C)}$$

wherein n represents an integer of at least 2; $A_9$ represents a single bond or an organic group having 2 valences when n is 2, or $A_9$ represents an organic group having n valences when n is not less than 3; M represents a cation; and a plurality of M may be the same or different.
4. The photographic bleach-fixing composition of item 1, wherein the photographic bleach-fixing composition comprises ammonium ions in a content of 0 to 30 mol % based on the total cation contained in the photographic bleach-fixing composition.

5. The photographic bleach-fixing composition of item 1, wherein the photographic bleach-fixing composition comprises sulfite ions in an amount of 0.05 to 0.5 mol/l.

6. A method for processing a color photographic material, comprising the steps of:

(a) developing the photographic material after being exposed; and (b) bleach-fixing using the bleach-fixing composition of item 1, wherein the replenishing solution is provided to the bleach-fixing bath in an amount of at most 80 ml per $m^2$ of the photographic material.

DETAILED DESCRIPTION OF THE INVENTION

The present invention will now be detailed.

Listed as preferred processing steps are:

color development→bleach-fixing→stabilization color development→bleach fixing→water washing.

The compounds represented by Formula (I), which are used in the bleach-fixing composition (or bleach-fixer) of the present invention, will now be described.

In Formula (I), $A^1$ through $A^4$ may be the same or different and each represents —$CH_2OH$, —$PO_3M_2$, or —COOM, wherein M represents a hydrogen atom, an alkali metal ion (for example, a sodium ion or a potassium ion), or another cation (for example, an ammonium ion, a methylammonium ion, or a trimethylammonium ion); X represents an alkylene group (including substituted groups) having from 2 to 6 carbon atoms or —$(B^1O)_n$—$B^2$—, wherein $B^1$ and $B^2$ may be the same or different and each represents an alkylene group (including substituted groups) having from 1 to 8 carbon atoms. Listed as alkylene groups represented by X are ethylene, trimethylene, and tetramethylene. Listed as alkylene groups represented by $B^1$ and $B^2$ are methylene, ethylene and trimethylene. Listed as substituents of the alkylene group represented by X, $B^1$, or $B^2$ are a hydroxyl group, an alkyl group (for example, a methyl group and an ethyl group) having from 1 to 3 carbon atoms. n represents an integer of 1 through 8, is preferably 1 through 4, and is more preferably 1 or 2.

Preferred as specific examples of the compounds represented by the aforesaid Formula (I) are listed below. However, the present invention is not limited to these examples.

I-1

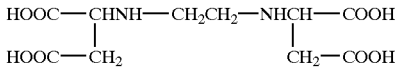

I-2

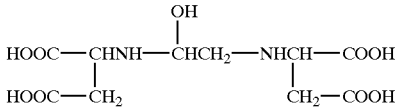

I-3

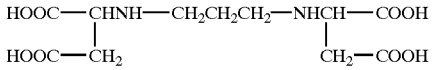

I-4

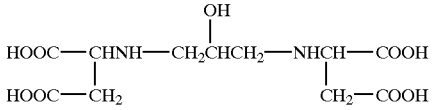

-continued

I-5

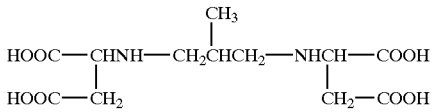

I-6

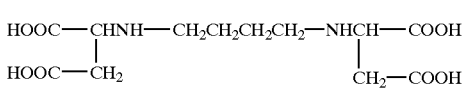

I-7

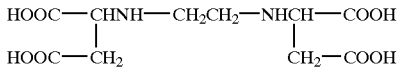

I-8

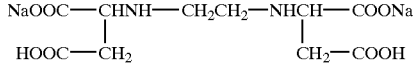

I-9

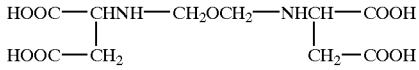

I-10

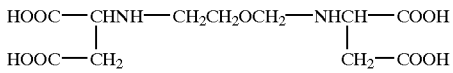

I-11

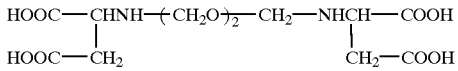

I-12

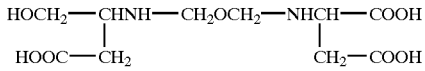

I-13

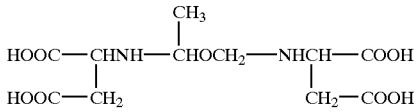

I-14

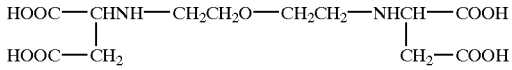

I-15

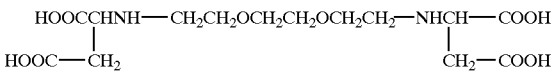

I-16

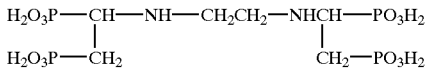

I-17

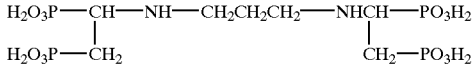

Potassium salts, sodium salts, or ammonium salts of the aforesaid compounds may also be employed.

Of these, preferred are compounds (I-1), (I-3), (I-5), and (I-15), and more preferred are compounds (I-1) and (I-3).

Further, of the compounds represented by Formula (I), S, S bodies, namely optical isomers, are preferred in the present invention.

It is possible to synthesize the compounds represented by the aforesaid Formula (I), employing generally known methods described in Zh. Obshch. Khim., 49, 659 (1979), Inorganic Chemistry, Vol. 7, 2405 (1968), Chem. Zresti, 32, 37 (1978), U.S. Pat. No. 3,158,635, and Japanese Patent Publication Open to Public Inspection No. 5-303186.

In the present invention, it is essential that the bleach-fixer comprises, as a bleaching agent, iron complexes of the compounds represented by the aforesaid Formula (I) and in addition, an (ethylenediaminetetraacetato)Fe(III) complex or a (diethylenetriaminepentaacetato)Fe(III) complex.

The potassium salt, sodium salt, or ammonium salt of the (ethylenediaminetetraacetato)Fe(III) complex or (diethylenetriaminepentaacetato)Fe(III) complex may also be employed.

In the present invention, it is required that Fe(III) complex concentration A (in mol/liter) and concentration B (in mol/liter) of an (ethylenediaminetetraacetato)Fe(III) complex or a (diethylenetriaminepentaacetato)Fe(III) complex satisfy the relationship of $0.9<A/B<5.0$. The relationship is preferably $1.5<A/B<4.0$, and is more preferably $2.0<A/B<3.0$.

It was discovered that when the bleaching agent related to the concentration B was an (ethylenediaminetetraacetato)Fe(III) complex, in the case of A/B being less than 0.9, the storage stability of the resultant bleach-fixer was degraded, and in the worst case, a large amount of sulfides was formed in the bleach-fixer, whereby problems occurred in which processing capability was degraded and poor tracking was caused in an automatic processor. On the other hand, in the case of A/B being more than 5.0, a large amount of deposits was generated at the surface of the bleach-fixer, and in the worst case, light-sensitive materials became commercially unviable due to adhesion of deposits onto the light-sensitive materials and the automatic processor suffered from poor tracking.

On the other hand, it was discovered that when the bleaching agent related to the concentration B was the (diethylenetriaminepentaacetato)Fe(III) complex, in the case of A/B being less than 0.9, the unexposed part (being a white background), when stored at high temperature as well as high humidity, resulted in yellow stains. Further, in the case of A/B being more than 5.0, a large amount of deposits was formed at the surface of the resultant bleach-fixer, whereby light-sensitive materials became commercially unviable due to adhesion of deposits onto the light-sensitive materials and the automatic processor suffered from poor tracking.

The inventors of the present invention performed diligent investigations and discovered that only when the relationship of $0.9<A/B<5.0$ was held, the effects of the present invention were exhibited. As a result, it was possible to achieve the present invention.

It is possible to employ Fe(III) complexes of the compounds described below.

In the present invention, from the viewpoint of managing the pH of the bleach-fixer, the bleach-fixer comprises preferably organic carboxylic acids, and more preferably comprises the compounds represented by Formula (C).

It has been known that when organic carboxylic acids, or the compounds represented by Formula (C), which are preferably employed in the present invention, are incorporated in a bleach-fixer, the ability of the resultant bleach-fixer is degraded and deposits at the surface of the bleach-fixer increase due to an increase in salt concentration. However, in the embodiment of the present invention, the problems are minimized and the effects of the present invention are more pronounced. Furthermore, from the viewpoint of bleaching performance (leuco dye formation properties), the embodiment of the present invention surprisingly exhibits effective means.

The compounds represented by Formula (C) will now be described.

In Formula (C), n represent an integer of at least 2, and when n=2, $A_9$ represent a single bond or an n-valent group, and when n=3, $A_9$ represent a trivalent group; M represent an alkali metal (for example, sodium or potassium) or other cations (for example, ammonium); and Ms of the number of n may be the same or different.

Specific examples of the compounds represented by Formula (C) are listed below. However, the present invention is not limited to these examples.

(Exemplified Compounds)

(C-1) HOCCH2C(OH)(COOH)$CH_2$COOH (C-2) HOOC(CHOH)$_2$COOH (C-3) HOOC$CH_2$COOH (C-4) HOOCCH(OH)$CH_2$COOH (C-5) HOOCCH═CHCOOH (C-6) HOOC$CH_2CH_2$COOH (C-7) $(COOH)_2$ (C-8)

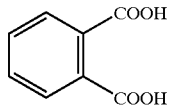

(C-9)

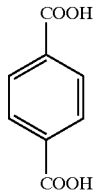

(C-10) NaOOCCH═CHCOONa (C-11) KOOCCH═CHCOOK (C-12) $H_4$NOOCCH═CHCOO$NH_4$ (C-13)

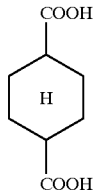

(C-14)

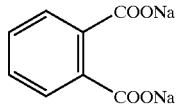

(C-15)

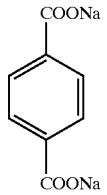

(C-16)

Of the exemplified compounds, preferred are (C-3), (C-4), (C-5), and (C-6).

The compounds, represented by Formula (C), may be employed in the form of an acid, or may be employed un the form of a potassium salt, a sodium salt, an ammonium salt, or a triethanolammonium salt.

The compounds, represented by Formula (C), are incorporated in a working bleach-fixer preferably in an amount of 0.05 to 2.00 mol per liter of the bleach-fixer, and more preferably in an amount of 0.2 to 1.0 mol per liter.

The proportion of the ammonium ions to the total cations in the bleach-fixer of the present invention is preferably from 0 to 30 mol percent, and is more preferably from 0 to 10 mol percent.

Preferably incorporated as organic acids in the present invention are the compounds represented by Formula (II) described below.

$$HOOC\text{-}(Z)_k\text{-}(X)_{n_{10}}$$

wherein X represents —COOM, —OH, —$SO_3H$, —PO3$M_1M_2$, wherein M, $M_1$, and $M_2$ each represents an alkali metal or a hydrogen atom, and X may be the same or different; $n_{10}$ represents an integer of 1 through 10; and Z represents a linking group having from 1 to 10 carbon atoms, which is comprised of n-valent carbon atoms and hydrogen atoms, or carbon atoms, hydrogen atoms and oxygen atoms; and k represents 0 or 1.

Exemplified as the organic acids are compounds selected from the group consisting of succinic acid, maleic acid, glycolic acid, adipic acid, citric acid, fumaric acid, and 2-phophonobutane-1,2,4-tricarboxylic acid.

In the embodiment of the present invention, when the proportion of the ammonium ions to the total cations in the bleach-fixer is from 0 to 30 mol percent, one of the effects of the present invention is more pronounced in which deposits at the surface of the bleach-fixer is minimized.

From the viewpoint of minimizing yellow stains in the unexposed area as well as minimizing deposits at the surface of the bleach-fixer, which are proposed as the effects of the present invention, the sulfite ion concentration in the bleach-fixer of the present invention is preferably from 0.05 to 0.50 mol/liter, and is more preferably from 0.10 to 0.30 mol/liter.

It is possible to accelerate the processing rate by adding, to the bleach fixer, imidazole and derivatives thereof or at least one type of the compounds represented by Formulas [I] through [IX] and exemplified compounds thereof, described in Japanese Patent Publication Open to Public Inspection No. 64-295258.

Besides the process accelerators, in the same manner employed may be exemplified compounds described on pages 51 through 115 of Japanese Patent Publication Open to Public Inspection No. 62-123459, exemplified compounds described on pages 22 through 25 of Japanese Patent Publication Open to Public Inspection No. 63-17445, and compounds described in Japanese Patent Publication Open to Public Inspection Nos. 53-95630 and 53-28326.

The bleach fixer is preferably employed at 20 to 50° C., and is more preferably employed at 25 to 45° C.

The pH of the bleach fixer is preferably from 5.0 to 9.0, and is more preferably from 5.5 to 8.0. Incidentally, the pH of the bleach fixer, as described herein, refers to the pH of the bleach fixer in a processing tank and does not refer to the pH of the replenisher.

Besides the additives described above, halides such as ammonium bromide, potassium bromide, and sodium bromide, various kinds of optical brightening agents, antifoaming agents, and surface active agents may be incorporated in the bleach fixer.

The replenishment rate of the bleach-fixer in the present invention is commonly less than or equal to 80 ml per $m^2$ of the light-sensitive material, and is preferably from 30 to 65 ml. The lower the replenishment rate, the more pronounced effects of the present invention.

In the present invention, in order to enhance the processing activity of the bleach-fixer, if desired, air or oxygen may be bubbled into the bleach fixer during processing and its replenisher in the storage tank. Alternatively, suitable oxidizing agents such as hydrogen peroxide, bromates, and persulfates may be appropriately added.

Preferably employed as fixing agents used in the bleach-fixer according to the present invention are thiocyanates as well as thiosulfates. The content of thiocyanates is preferably at least 0.1 mol/liter. When color negative films are processed, the content is more preferably at least 0.5 mol/liter, and is still more preferably at least 1.0 mol/liter. On the other hand, the content of thiosulfates is preferably at least 0.2 mol/liter. When color negative film is processed, the content is more preferably at least 0.5 mol/liter.

Other than these fixing agents, pH buffers, comprised of various salts, may be incorporated individually or in combination in the bleach-fixer according to the present invention. Further, it is preferable that a large amount of rehalogenation agents such as alkali halides or ammonium halides, e.g. potassium bromide, sodium bromide, sodium chloride, or ammonium bromide be incorporated. Further, it is possible to optionally add compounds such as alkylamines and polyethylene oxides which are known as common additives to the bleach-fixer.

Incidentally, silver may be recovered from the bleach-fixer according to the present invention, employing conventional methods known in the art.

Processing time in the bleach fixer is flexible, but is preferably at most 3 minutes 30 seconds, is more preferably from 10 seconds to 2 minutes 20 seconds, and is most preferably from 20 seconds to 1 minute 20 seconds.

After the bleach-fixing according to the present invention, it is preferable that stabilization be carried out employing a stabilizer.

In order to achieve the purposes of the present invention, it is preferable that the stabilizer comprises chelating agents having a chelate stability constant of at least 8 with respect to iron ions. The chelate stability constant, as described herein, refers to the generally known constant described in L. G. Sillen and A. E. Marttell, "Stability Constants of Metal-Ion Complexes", The Chemical Society of London (1964), and S. Chaberek and A. E. Martell, "Organic Sequestering Agents", Wiley (1959).

Cited as chelating agents having a chelate stability constant of at least 8 with respect to iron ions are organic carboxylic acid chelating agents, organic phosphoric acid chelating agents, inorganic phosphoric acid chelating agents, and polyhydroxy compounds. Incidentally, the aforesaid iron ions refer to ferric ions (being $Fe^{3+}$).

Listed as specific examples of chelating compounds, having a chelate stability constant of at least 8 with respect to ferric ions, are the compounds listed below. However, the present invention is not limited to these examples. Namely, employed preferably are ethylenediamineorthohydroxyphenylacetic acid, diaminopropanetetraacetic acid, nitrilotriacetic acid, hydroxyethylenediaminetriacetic acid, dihyroxyethylglycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, glycoletherdiaminetetraacetic acid, ethylenediaminetetrakismethylenesulfonic acid, nitrilotrimethylenephosphonic acid, 1-hydroxyethilidene-1,1-diphosphonic acid, 1,1-diphophonoethane-2-carboxylic acid, 2-phosphonobutane-1,2,4-tricarboxylic acid, 1-hydroxy-1-phosphnopropane-1,2,3-tricarboxylic acid, catechol-3,5-diphosphonic acid, sodium pyrophosphate, sodium tetrapolyphosphate, and sodium hexametaphosphate. Of these, diethylenetriaminepentaacetic acid, nitrilotriacetic acid, nitrilotrimethylenephosphonic acid, 1-hydroxyethylidene-1,1-diphosphonic acid are preferably employed. Further, of these, 1-hydroxyethylidene-1,1-diphosphonic acid is most preferably employed.

The used amount of the chelating agents is preferably from 0.01 to 50.00 g per liter of the stabilizer, and desired results are obtained in an amount in the range of 0.05 to 20.00 g.

Listed as preferred compounds added to the stabilizer are ammonium compounds. The ammonium compounds can be supplied in the form of various kinds of inorganic and organic ammonium salts. Specific compounds include ammonium hydroxide, ammonium bromide, ammonium carbonate, ammonium chloride, ammonium hypophosphite, ammonium phosphate, ammonium phosphite, ammonium fluoride, acid ammonium fluoride, ammonium fluoroborate, ammonium arsenate, ammonium hydrogencarbonate, ammonium hydrogenfluoride, ammonium hydrogensulfate, ammonium sulfate, ammonium iodide, ammonium nitrate, ammonium pentaborate, ammonium acetate, ammonium adipate, ammonium laurictricarboxylate, ammonium benzoate, ammonium carbamate, ammonium citrate, ammonium diethylthiocarbamate, ammonium formate, ammonium hydrogenmalate, ammonium hydrogenoxalate, ammonium hydrogenphthalate, ammonium hydrogentartarate, ammonium thiosulfate, ammonium sulfite, ammonium ethylenediaminetetraacetate, ammonium (ethylenediaminetetraacetato)iron(III), ammonium lactate, ammonium, malate, ammonium maleate, ammonium oxalate, ammonium phthalate, ammonium picrate, ammonium pyrrolidinedithiocarbamate, ammonium salicylate, ammonium succinate, ammonium sulfanilate, ammonium tartarate, ammonium thioglycolate, and 2,4,6-trinitrophenolammonium. These may be employed individually or in combinations of at least two types. The added amount of ammonium compounds is preferably in the range of 0.001 to 1.0 mol per liter of the stabilizer, and is more preferably in the range of 0.002 to 0.8 mol/liter.

Further, it is preferable that sulfites be added to the stabilizer. Employed as the sulfites may be organic or inorganic compounds, as long as they release sulfite ions. However, inorganic salts are preferably employed. Listed as preferred specific compounds are sodium sulfite, potassium sulfite, ammonium sulfite, ammonium bisulfite, potassium bisulfite, sodium bisulfite, sodium metabisulfite, potassium metabisulfite, ammonium metabisulfite, and hydrosulfite. The sulfites are preferably added to the stabilizer in an amount so as to result in at least $1\times10^{-3}$ mol/liter, and more preferably from $5\times10^{-3}$ to $10^{-1}$ mol/liter, whereby stains are specifically minimized. The sulfites may be added directly to the stabilizer. However, it is preferable that the sulfites be added to the replenisher of the stabilizer.

Listed as generally known compounds which can be added to the stabilizer are polyvinylpyrrolidone (PVP K-15, K-30, and K-90), organic acid salts (citric acid, acetic acid, succinic acid, oxalic acid, and benzoic acid), mildewcides (phenol derivatives, catechol derivatives, imidazole derivatives, triazole derivatives, thiabendazole derivatives, organic halogen compounds, and others such as mildewcides known as a slime control agents in the paper-pulp industry, optical brightening agents, surface active agents, antiseptic agents, and salts of metals such as Bi, Mg, Zn, Ni, Al, Sn, Ti, and Zr. The compounds may be employed individually or in combination in an amount range which does not adversely affect the effects of the present invention.

After stabilization, water washing is not at all needed. However, if desired, it is possible to optionally carry out rinsing or surface washing over a very short time employing a small amount of water.

In order to exhibit the effects of the present invention, it is preferable that the stabilizer comprises soluble iron salts. The soluble iron salts are employed in the stabilizer preferably at a concentration of at least $5\times10^{-3}$ mol/liter, more preferably at a concentration range of $8\times10^{-3}$ to $150\times10^{-3}$ mol/liter, and still more preferably at concentration range of $12\times10^{-3}$ to $100\times10^{-3}$ mol/liter. Further, the soluble iron salts may be added to the stabilizer replenisher so as to be mixed with the working stabilizer in the tank. Alternatively, the soluble iron salts may be incorporated in a light-sensitive material so as to be dissolved in the working stabilizer in the tank. Further, the soluble iron salts may be added to the precedent bath so as to adhere to processed light-sensitive materials and transferred to the working stabilizer in the tank.

Further, in the present invention, a stabilizer may be employed which has been subjected to a treatment employing ion-exchange resins so that the amount of calcium ions as well as magnesium ions is adjusted to less than or equal to 5 ppm. Still further, in addition to the methods, a method may be employed in which the mildewcides, as well as halogen ion releasing agents, are incorporated.

In the present invention, the pH of the stabilizer is preferably in the range of 5.5 to 10.0. Employed as pH regulators which can be incorporated in the stabilizer may be any of the generally known alkalis or acids.

Processing temperature during stabilization is preferably in the range of 15 to 70° C., and is more preferably in the range of 20 to 55° C. The processing time is preferably less than or equal to 120 seconds, is more preferably from 3 to 90 seconds, and is most preferably from 6 to 50 seconds.

From the viewpoint of quick processability as well as the retention properties of dye images, the replenishment rate of the stabilizer is preferably from 0.1 to 50 times the rate of carry-in of the precedent bath per unit area of the light-sensitive material, and is more preferably from 0.5 to 30 times the rate.

The stabilizer tank is preferably comprised of a plurality of tanks. The number of tanks is preferably from 2 to 6, is more preferably from 2 to 3 tanks, and is most preferably 2. Further, it is preferable that a counter-current system (in which the stabilizer is supplied to the post-bath so as to overflow into the pre-bath) is realized.

Prior to the process employing the bleach-fixer according to the present invention, color development is carried out. Color developing agents employed in the color development include aminophenol based compounds, as well as p-phenylenediamine based compounds. Of these, in the present invention, preferably employed are the p-phenylenediamine based compounds having a water-soluble group. At least one of the water-soluble groups is included in an amino group or a benzene nucleus of the p-phenylenediamine based compounds. Preferably listed as specific water-soluble groups are $—(CH_2)_n—CH_2OH$, $—(CH_2)_m—NHSO_2—(CH_2)_n—CH_3$, $—(CH_2)_m—O—(CH_2)n—CH_3$, and $—(CH_2CH_2O)_n—C_mH_{2m+1}$ (wherein m and n each represents an integer of more than or equal to 0), and a —COOH group and a $—SO_3H$ group.

Listed as specific examples of color developing agents preferably employed in the present invention are listed below.

Exemplified Color Developing Agents
(A-1)
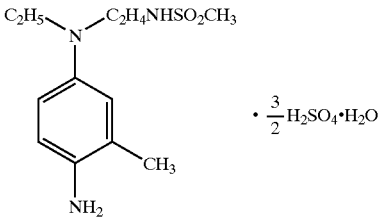
(A-2)
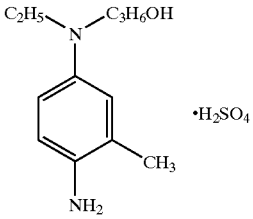
(A-3)
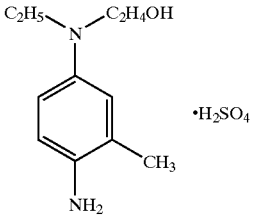
(A-4)
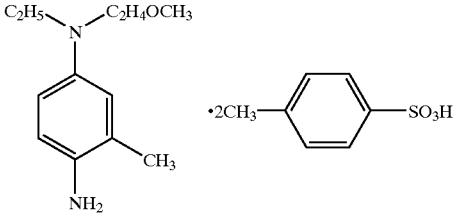
(A-5)
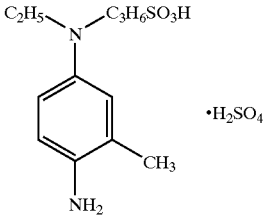
(A-6)
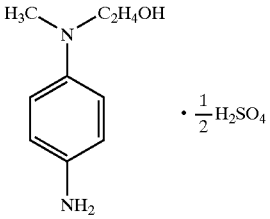
(A-7)
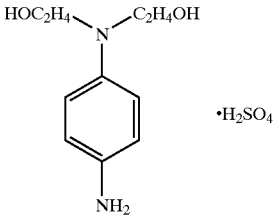
-continued
(A-8)
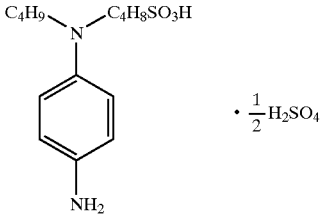
(A-9)
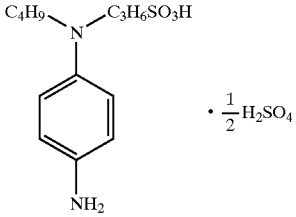
(A-10)
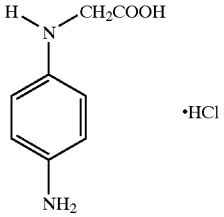
(A-11)
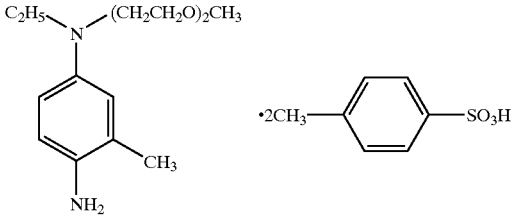
(A-12)
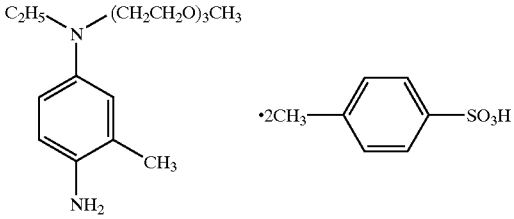
(A-13)
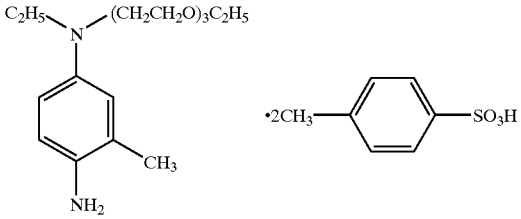

-continued (A-14)

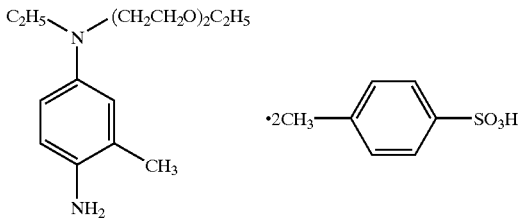

(A-15)

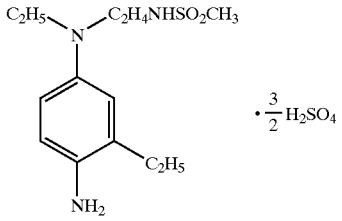

(A-16)

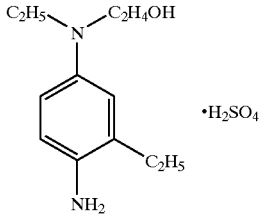

Of color developing agents exemplified above, the compounds, represented by (A-1), (A-2), (A-3), (A-4), (A-6), (A-7), and (A-15), are preferably employed in the present invention, and of these, the compound, represented by (A-1) or (A-3), is particularly preferred.

The aforesaid color developing agents are commonly employed in the form of salts such as chlorides, sulfates, or p-toluenesulfonates. The added amount of color developing agents is preferably at least $0.5\times10^{-2}$ mole per liter of the color developer, is more preferably in the range of $1.0\times10^{-2}$ to $1.0\times10^{-1}$ mol, and is most preferably in the range of $1.5\times10^{-2}$ to $7.0\times10^{-2}$ mol.

A color developer, which is employed in a dye forming and developing process, may comprise alkalis such as sodium hydroxide, potassium hydroxide, ammonium hydroxide, sodium carbonate, potassium carbonate, sodium sulfate, sodium metaborate, or borax, which are commonly employed in a developer. Further, various additives, for example, benzyl alcohol, alkali metal halides such as potassium bromide or potassium chloride, or development control agents such as citrazinic acid, and preserving agents such as hydroxylamine, and derivatives thereof (for example, hydrazinodiacetic acid) or sulfites may be incorporated. Further, various kinds of antifoaming agents and surface active agents, and organic solvents such as methanol, dimethylformamide, or dimethylsulfoxide may also be incorporated.

The pH of the color developer is commonly at least 7, and is preferably from about 9 to about 13.

If desired, incorporated as antioxidants in the color developer may be tetronic acid, tetronimide, 2-anilinoethanol, dihydroxyacetone, aromatic secondary alcohols, hydroxamic acid, pentose or hexose, and pyrogallol-1,3-dimethyl ether.

In the color developer, employed as a metal ion sequestering agent may be various types of chelating agents together with other additives. Listed as the chelating agents are, for example, aminopolycarboxylic acids such as ethylenediaminetetraacetic acid and diethylenetriaminepentaacetic acid; organic phosphonic acids such as 1-hydroxyethylidene-1,1-diphosphonic acid; aminopolyphosphonic acids such as aminotri(methylenephosphonic acid) or ethylenediaminetetraphosphoric acid; oxycarboxylic acids such as citric acid or gluconic acid; phosphonocarboxylic acids such as 2-phosphonobutane-1,2,4-tricarboxylic acid; and polyphosphoric acids such as tripolyphosphoric acid or hexametaphosphoric acid.

In regard to color negative film, the replenishment rate of the color developer in continuous processing is preferably 1,500 ml/m$^2$ of the color film, is more preferably from 250 to 900 ml/m$^2$, and is still more preferably from 30 to 160 ml/m$^2$. In the case of color paper processing, the replenishment rate of the color developer is commonly from 20 to 300 ml/m$^2$, and is preferably from 30 to 160 ml/m$^2$.

EXAMPLES

The present invention will now be described with specific reference to examples. However, the present invention is not limited to these examples.

Example 1

QA Color Paper Type QD, manufactured by Konica Corp., was exposed employing a conventional method. Subsequently, the color paper, having unexposed parts as well as exposed parts, was subjected to running processing employing an automatic processor based on the processing steps described below, while employing the processing solutions described below.

The processed amount of the running process was 0.07R per day. The continuous processing was carried out until the volume in the bleach-fixer tank, which had been replenished into the bleach-fixer tank, became 3 times the volume of the bleach-fixer in the tank. Incidentally, 1R, as described herein, means that the bleach-fixer replenisher, having the same volume as the bleach-fixer in the tank is replenished.

| Processing Step | Processing Temperature | Processing Time | Replenishment Rate |
|---|---|---|---|
| (1) Color Development | 37.5 ± 0.3° C. | 20 seconds | 55 ml/m$^2$ |
| (2) Bleach-Fixing | 37.5 ± 0.5° C. | 20 seconds | 55 ml/m$^2$ |
| (3) Stabilization (3-tank cascade) | 30 to 34° C. | 90 seconds | 200 ml/m$^2$ |
| (4) Drying | 60 to 80° C. | 30 seconds | |

(Color Developer)

| | |
|---|---|
| Triethanolamine | 10 g |
| Diethylene glycol | 10 g |
| N,N-diethylhydroxylamine | 3.6 g |
| Hydrazinediacetic acid | 5.0 g |
| Potassium bromide | 20 mg |
| Potassium chloride | 2.5 g |
| Diethylenetriaminepentaacetic acid | 5 g |
| Potassium sulfite | 0.2 g |
| Developing agent (3-methyl-4-amino-N-ethyl-N-(β-methanesulfonamidoethyl) aniline sulfate) | 6.0 g |
| Potassium carbonate | 25 g |
| Potassium hydrogencarbonate | 5 g |
| Water to make | 1 liter |

The pH was adjusted to 10.10 by adding potassium hydroxide or sulfuric acid.

| (Color Developer Replenisher) | |
|---|---|
| Triethanolamine | 14.0 g |
| Diethylene glycol | 12 g |
| N,N-diethylhydroxylamine | 5 g |
| Hydrazinediacetic acid | 7.5 g |
| Potassium chloride | 0.1 g |
| Diethylenetriaminepentaacetic acid | 7.5 g |
| Potassium sulfite | 0.3 g |
| Developing agent (3-methyl-4-amino-N-ethyl-N-(β-methanesulfonamidoethyl) aniline sulfate) | 9.8 g |
| Potassium carbonate | 30 g |
| Potassium hydrogencarbonate | 1 g |
| Water to make | 1 liter |

The pH was adjusted to 10.65 by adding potassium hydroxide or sulfuric acid.

| (Bleach-Fixer) | |
|---|---|
| Organic acid Fe(III) complex (described in Tables 1 and 2) | described in Tables 1 and 2 |
| Sodium thiosulfate | 60 g |
| Sodium sulfite | 0.35 mol |
| Water to make | 1 liter |

The pH was adjusted to 6.2 by adding potassium hydroxide or sulfuric acid.

(Bleach-Fixer Replenisher)

The concentration of each of the additives described above was increased by 1.3 times and the pH was adjusted to 5.0.

| (Stabilizer and Stabilizer Replenisher) | |
|---|---|
| o-Phenylphenol | 0.1 g |
| Cinopal SFP (manufactured by Ciba-Geigy Co.) | 1.0 g |
| Zinc sulfate | 0.2 g |
| Ammonium sulfite (40 percent solution) | 5.0 ml |
| 1-Hydroxyethylidene-1,1-diphosphonic acid (60 percent solution) | 5.0 g |
| Ethylenediaminetetraacetic acid | 1.5 g |

The pH was adjusted to 7.8 by adding ammonia water or sulfuric acid, and the total volume was adjusted to 1 liter by adding water.

After carrying out running processing, the resultant processed samples were stored at 60° C. and relative humidity 80 percent for 14 days.

Further, before and after the storage, the yellow reflection density of the unexposed portions of each sample was determined employing an X-rite densitometer.

Still further, at the completion of the running processing, 200 ml of the bleach-fixer in the tank was sampled and placed in a 250 ml beaker. The beaker was set aside at 40° C. for 14 days, and deposits in the beaker were observed and evaluated based on the criteria described below.

<Evaluation Criteria>

A: no deposits were noticed in the beaker nor at the surface of the solution

B: slight deposits were noticed in the beaker as well as at the surface of the solution C: problematic deposits were clearly noticed in the beaker as well as at the surface of the solution C: a large amount of deposits was noticed in the beaker as well as at the surface of the solution.

Tables 1 and 2 show the results.

TABLE 1

| Test No. | Organic Acid Fe (III) Complex (B) | Organic Acid Fe (III) Complex (A) | A/B | Yellow Stains after Storage ($\Delta D_{min}Y$) | Deposits Evaluation | Remarks |
|---|---|---|---|---|---|---|
| 1-1 | EDTA-Fe 0.2 mol/l | none | 0 | 0.06 | D | Comp. |
| 1-2 | EDTA-Fe 0.15 mol/l | EDDS-Fe 0.05 mol/l | 0.33 | 0.05 | D | Comp. |
| 1-3 | EDTA-Fe 0.12 mol/l | EDDS-Fe 0.08 mol/l | 0.75 | 0.04 | C | Comp. |
| 1-4 | EDTA-Fe 0.105 mol/l | EDDS-Fe 0.095 mol/l | 0.90 | 0.02 | B | Inv. |
| 1-5 | EDTA-Fe 0.08 mol/l | EDDS-Fe 0.12 mol/l | 1.5 | 0.01 | A | Inv. |
| 1-6 | EDTA-Fe 0.06 mol/l | EDDS-Fe 0.14 mol/l | 2.33 | 0.01 | A | Inv. |
| 1-7 | EDTA-Fe 0.05 mol/l | EDDS-Fe 0.15 mol/l | 3.0 | 0.01 | A | Inv. |
| 1-8 | EDTA-Fe 0.04 mol/l | EDDS-Fe 0.16 mol/l | 4.0 | 0.01 | A | Inv. |
| 1-9 | EDTA-Fe 0.035 mol/l | EDDS-Fe 0.165 mol/l | 4.71 | 0.01 | B | Inv. |
| 1-10 | EDTA-Fe 0.03 mol/l | EDDS-Fe 0.17 mol/l | 5.66 | 0.01 | D | Comp. |
| 1-11 | EDTA-Fe 0.15 mol/l | DTPA-Fe 0.05 mol/l | 0.33 | 0.09 | D | Comp. |
| 1-12 | EDTA-Fe 0.12 mol/l | DTPA-Fe 0.08 mol/l | 0.75 | 0.1 | C | Comp. |
| 1-13 | EDTA-Fe 0.105 mol/l | DTPA-Fe 0.095 mol/l | 0.90 | 0.1 | B | Comp. |
| 1-14 | EDTA-Fe 0.08 mol/l | DTPA-Fe 0.12 mol/l | 1.5 | 0.11 | A | Comp. |
| 1-15 | EDTA-Fe 0.06 mol/l | DTPA-Fe 0.14 mol/l | 2.33 | 0.13 | A | Comp. |
| 1-16 | EDTA-Fe 0.05 mol/l | DTPA-Fe 0.15 mol/l | 3.0 | 0.14 | A | Comp. |
| 1-17 | EDTA-Fe 0.04 mol/l | DTPA-Fe 0.16 mol/l | 4.0 | 0.15 | A | Comp. |
| 1-18 | EDTA-Fe 0.035 mol/l | DTPA-Fe 0.165 mol/l | 4.71 | 0.18 | B | Comp. |
| 1-19 | EDTA-Fe 0.03 mol/l | DTPA-Fe 0.17 mol/l | 5.66 | 0.19 | D | Comp. |
| 1-20 | EDTA-Fe 0.15 mol/l | PDTA-Fe 0.05 mol/l | 0.33 | 0.07 | D | Comp. |
| 1-21 | EDTA-Fe 0.06 mol/l | PDTA-Fe 0.14 mol/l | 2.33 | 0.03 | D | Comp. |
| 1-22 | EDTA-Fe 0.03 mol/l | PDTA-Fe 0.17 mol/l | 5.66 | 0.03 | D | Comp. |

Comp.: Comparative Example
Inv.: Present Invention

TABLE 2

| Test No. | Organic Acid Fe (III) Complex (B) | Organic Acid Fe (III) Complex (A) | A/B | Yellow Stains after Storage ($\Delta D_{min}Y$) | Deposits Evaluation | Remarks |
|---|---|---|---|---|---|---|
| 2-1 | DTPA-Fe 0.2 mol/l | none | 0 | 0.25 | B | Comp. |
| 2-2 | DTPA-Fe 0.15 mol/l | EDDS-Fe 0.05 mol/l | 0.33 | 0.12 | B | Comp. |
| 2-3 | DTPA-Fe 0.12 mol/l | EDDS-Fe 0.08 mol/l | 0.75 | 0.08 | B | Comp. |
| 2-4 | DTPA-Fe 0.105 mol/l | EDDS-Fe 0.095 mol/l | 0.90 | 0.03 | B | Inv. |
| 2-5 | DTPA-Fe 0.08 mol/l | EDDS-Fe 0.12 mol/l | 1.5 | 0.02 | A | Inv. |
| 2-6 | DTPA-Fe 0.06 mol/l | EDDS-Fe 0.14 mol/l | 2.33 | 0.01 | A | Inv. |

TABLE 2-continued

| Test No. | Organic Acid Fe (III) Complex (B) | Organic Acid Fe (III) Complex (A) | A/B | Yellow Stains after Storage ($\Delta D_{min}Y$) | Deposits Evaluation | Remarks |
|---|---|---|---|---|---|---|
| 2-7 | DTPA-Fe 0.05 mol/l | EDDS-Fe 0.15 mol/l | 3.0 | 0.01 | A | Inv. |
| 2-8 | DTPA-Fe 0.04 mol/l | EDDS-Fe 0.16 mol/l | 4.0 | 0.01 | A | Inv. |
| 2-9 | DTPA-Fe 0.035 mol/l | EDDS-Fe 0.165 mol/l | 4.71 | 0.01 | B | Inv. |
| 2-10 | DTPA-Fe 0.03 mol/l | EDDS-Fe 0.17 mol/l | 5.66 | 0.01 | D | Comp. |
| 2-11 | DTPA-Fe 0.15 mol/l | DTPA-Fe 0.05 mol/l | 0.33 | 0.14 | B | Comp. |
| 2-12 | DTPA-Fe 0.12 mol/l | DTPA-Fe 0.08 mol/l | 0.75 | 0.1 | B | Comp. |
| 2-13 | DTPA-Fe 0.105 mol/l | DTPA-Fe 0.095 mol/l | 0.90 | 0.1 | B | Comp. |
| 2-14 | DTPA-Fe 0.08 mol/l | DTPA-Fe 0.12 mol/l | 1.5 | 0.1 | A | Comp. |
| 2-15 | DTPA-Fe 0.06 mol/l | DTPA-Fe 0.14 mol/l | 2.33 | 0.1 | A | Comp. |
| 2-16 | DTPA-Fe 0.05 mol/l | DTPA-Fe 0.15 mol/l | 3.0 | 0.09 | A | Comp. |
| 2-17 | DTPA-Fe 0.04 mol/l | DTPA-Fe 0.16 mol/l | 4.0 | 0.09 | A | Comp. |
| 2-18 | DTPA-Fe 0.035 mol/l | DTPA-Fe 0.165 mol/l | 4.71 | 0.08 | B | Comp. |
| 2-19 | DTPA-Fe 0.03 mol/l | DTPA-Fe 0.17 mol/l | 5.66 | 0.07 | D | Comp. |
| 2-20 | DTPA-Fe 0.15 mol/l | PDTA-Fe 0.05 mol/l | 0.33 | 0.14 | D | Comp. |
| 2-21 | DTPA-Fe 0.06 mol/l | PDTA-Fe 0.14 mol/l | 2.33 | 0.09 | C | Comp. |
| 2-22 | DTPA-Fe 0.03 mol/l | PDTA-Fe 0.17 mol/l | 5.66 | 0.06 | C | Comp. |

Comp.: Comparative Example
Inv.: Present Invention
EDTA-Fe: (ethylenediaminetetraacetato) Fe (III) sodium salt
DPTA-Fe: (diethylenetriaminepentaacetato) Fe (III) sodium salt
PDTA-Fe: (propylenediaminetetraacetato) Fe (III) sodium salt
EDDS-Fe: sodium ferrate of (I-1)

As can clearly be seen from Table 1, when concentration A (in mol/liter) of the ferric complex represented by Formula [I] and concentration B (in mol/liter) of an (ethylenediaminetetraacetato)Fe(III) complex or a (diethylenetriaminepentaacetato)Fe(III) complex satisfied the relationship of $0.9<A/B<5.0$, the desired effects of the present invention were exhibited. It should also be that the relationship was preferably $1.5<A/B<4.0$, and was more preferably $2.0<A/B<3.0$.

In the case in which the bleaching agent related to B was an (ethylenediaminetetraacetato)Fe(III) complex, it was found that when A/B was less than 0.9, the storage stability of the bleach-fixer was degraded, and in the worst case, a large amount of sulfides was formed in the bleach-fixer, while when A/B exceeded 5.0, a large amount of deposits was generated at the surface of the bleach-fixer.

Further, in cases in which the bleaching agent regarding B was a (diethylenetriaminepentaacetato)Fe(III) complex, it was found that when A/B was less than 0.9, the unexposed portion (being the white background) of the resultant image resulted in yellow stains during storage at high temperature and high humidity, while when A/B exceeded 5.0, a large amount of deposits was also generated at the surface of the bleach-fixer.

Example 2

Tests were carried out in the same manner as Example 1, except that EDDS, described in organic acid ferric complex (A) of Tables 1 and 2, was replaced with (I-3), (I-5), and (I-15). As a result, it was found that the desired effects of the present invention were exhibited in the same manners as Example 1.

Example 3

Processing was carried out in the same manner as Example 1, except that the former bleach fixer was replaced with the bleach-fixer described below.

| (Bleach-Fixer) | | |
|---|---|---|
| Organic acid Fe(III) complex (described in Table 3) | described in Table 3 | |
| Sodium thiosulfate | 60 | g |
| Sodium sulfite | 0.35 | mol |
| Organic acid | 0.1 | mol |
| Water to make | 1 | liter |

The pH was adjusted to 6.2 by adding potassium hydroxide or sulfuric acid.

(Bleach-Fixer Replenisher)

The concentration of each of the additives described above was increased by a factor of 1.3 and the pH was adjusted to 5.0.

After carrying out running processing, before and after the storage of processed sample prepared in the same manner as Example 1, the yellow reflection density of the unexposed portion of each sample was determined employing an X-rite densitometer. At the completion of the running processing, the bleach-fixer in the tank was sampled and was set aside at 40° C. for 14 days, and thereafter, deposits in the beaker were observed and evaluated in the same manner as Example 1.

Further, the degree of leuco dye formation was evaluated based on the method described below.

<<Evaluation of Degree of Leuco Dye Formation>>

With regard to one of the exposed portions of the resultant processed sample which had been divided into two parts, first, the red reflection density was determined employing an X-rite densitometer. Subsequently, the measured sample was immersed in an aqueous EDTA-Fe solution (concentration of EDTA-Fe $NH_4$: 0.2 mol/liter, and pH: 6.0) at room temperature for 5 minutes, then washed and dried. Thereafter, the red reflection density of the resultant sample was measured employing an X-rite densitometer.

Based on the value obtained by subtracting the red reflection density of the sample immersed in the aqueous EDTA-Fe solution from the red density of the sample prior to immersing the aqueous EDTA-Fe solutions, the degree of leuco dye formation was evaluated.

Table 3 shows the results.

TABLE 3

| Test No. | Organic Acid Fe (III) Complex (B) | Organic Acid Fe (III) Complex (A) | A/B | Organic Acid | Yellow Stains after Storage ($\Delta D_{min}Y$) | Deposits Evaluation | Degree of Leuco Dye Formation | Remarks |
|---|---|---|---|---|---|---|---|---|
| 3-1 | EDTA-Fe 0.2 mol/l | none | 0 | none | 0.06 | D | −0.03 | Comp. |
| 3-2 | EDTA-Fe 0.12 mol/l | EDDS-Fe 0.08 mol/l | 0.75 | none | 0.04 | C | −0.03 | Comp. |
| 3-3 | EDTA-Fe 0.06 mol/l | EDDS-Fe 0.14 mol/l | 2.33 | none | 0.01 | A | −0.03 | Inv. |
| 3-4 | EDTA-Fe 0.035 mol/l | EDDS-Fe 0.165 mol/l | 4.71 | none | 0.01 | B | −0.02 | Inv. |
| 3-5 | EDTA-Fe 0.03 mol/l | EDDS-Fe 0.17 mol/l | 5.66 | none | 0.01 | C | −0.02 | Comp. |
| 3-6 | EDTA-Fe 0.2 mol/l | none | 0 | C-5 0.1 mol/l | 0.07 | D | −0.07 | Comp. |
| 3-7 | EDTA-Fe 0.12 mol/l | EDDS-Fe 0.08 mol/l | 0.75 | C-5 0.1 mol/l | 0.05 | C | −0.06 | Comp. |
| 3-8 | EDTA-Fe 0.06 mol/l | EDDS-Fe 0.14 mol/l | 2.33 | C-5 0.1 mol/l | 0.02 | A | −0.02 | Inv. |
| 3-9 | EDTA-Fe 0.035 mol/l | EDDS-Fe 0.165 mol/l | 4.71 | C-5 0.1 mol/l | 0.01 | B | −0.02 | Inv. |
| 3-10 | EDTA-Fe 0.03 mol/l | EDDS-Fe 0.17 mol/l | 5.66 | C-5 0.1 mol/l | 0.01 | C | −0.06 | Comp. |
| 3-11 | EDTA-Fe 0.2 mol/l | none | 0 | Acetic Acid 0.1 mol/l | 0.09 | D | −0.05 | Comp. |
| 3-12 | EDTA-Fe 0.12 mol/l | EDDS-Fe 0.08 mol/l | 0.75 | Acetic Acid 0.1 mol/l | 0.01 | C | −0.04 | Comp. |
| 3-13 | EDTA-Fe 0.06 mol/l | EDDS-Fe 0.14 mol/l | 2.33 | Acetic Acid 0.1 mol/l | 0.01 | A | −0.02 | Inv. |
| 3-14 | EDTA-Fe 0.035 mol/l | EDDS-Fe 0.165 mol/l | 4.71 | Acetic Acid 0.1 mol/l | 0.01 | B | −0.02 | Inv. |
| 3-15 | EDTA-Fe 0.03 mol/l | EDDS-Fe 0.17 mol/l | 5.66 | Acetic Acid 0.1 mol/l | 0.01 | C | −0.05 | Comp. |
| 3-16 | DTPA-Fe 0.2 mol/l | none | 0 | none | 0.25 | B | −0.21 | Comp. |
| 3-17 | DTPA-Fe 0.12 mol/l | EDDS-Fe 0.08 mol/l | 0.75 | none | 0.08 | A | −0.15 | Comp. |
| 3-18 | DTPA-Fe 0.06 mol/l | EDDS-Fe 0.14 mol/l | 2.33 | none | 0.01 | A | −0.05 | Inv. |
| 3-19 | DTPA-Fe 0.035 mol/l | EDDS-Fe 0.165 mol/l | 4.71 | none | 0.01 | B | −0.03 | Inv. |
| 3-20 | DTPA-Fe 0.03 mol/l | EDDS-Fe 0.17 mol/l | 5.66 | none | 0.01 | D | −0.03 | Comp. |
| 3-21 | DTPA-Fe 0.2 mol/l | none | 0 | C-5 0.1 mol/l | 0.28 | B | −0.26 | Comp. |
| 3-22 | DTPA-Fe 0.12 mol/l | EDDS-Fe 0.08 mol/l | 0.75 | C-5 0.1 mol/l | 0.11 | A | −0.20 | Comp. |
| 3-23 | DTPA-Fe 0.06 mol/l | EDDS-Fe 0.14 mol/l | 2.33 | C-5 0.1 mol/l | 0.01 | A | −0.06 | Inv. |
| 3-24 | DTPA-Fe 0.035 mol/l | EDDS-Fe 0.165 mol/l | 4.71 | C-5 0.1 mol/l | 0.01 | B | −0.04 | Inv. |
| 3-25 | DTPA-Fe 0.03 mol/l | EDDS-Fe 0.17 mol/l | 5.66 | C-5 0.1 mol/l | 0.01 | D | −0.03 | Comp. |
| 3-26 | DTPA-Fe 0.2 mol/l | none | 0 | Acetic Acid 0.1 mol/l | 0.32 | B | −0.22 | Comp. |
| 3-27 | DTPA-Fe 0.12 mol/l | EDDS-Fe 0.08 mol/l | 0.75 | Acetic Acid 0.1 mol/l | 0.13 | A | −0.18 | Comp. |
| 3-28 | DTPA-Fe 0.06 mol/l | EDDS-Fe 0.14 mol/l | 2.33 | Acetic Acid 0.1 mol/l | 0.02 | A | −0.05 | Inv. |
| 3-29 | DTPA-Fe 0.035 mol/l | EDDS-Fe 0.165 mol/l | 4.71 | Acetic Acid 0.1 mol/l | 0.01 | B | −0.03 | Inv. |
| 3-30 | DTPA-Fe 0.03 mol/l | EDDS-Fe 0.17 mol/l | 5.66 | Acetic Acid 0.1 mol/l | 0.01 | D | −0.03 | Comp. |

Comp.: Comparative Example
Inv.: Present Invention

As can clearly be seen from Table 3, in the present invention, incorporating the organic carboxylic acid according to the present invention exhibited an effective means from the viewpoint of bleaching properties (minimization of leuco dye formation) in addition to the effects of the present invention.

Example 4

Tests were carried out in the same manner as Example 1, except that the ratio of ammonium ions to total cations in the bleach-fixer was varied as shown in Table 4 by varying the cation ratio in the bleach-fixer.

Evaluation was carried out in the same manner as Example 3. Table 4 shows the results.

TABLE 4

| Test No. | Organic Acid Fe (III) Complex (B) | Organic Acid Fe (III) Complex (A) | A/B | Ammonium Ion Concentration Ratio (in %) | Yellow Stains after Storage ($\Delta D_{min}Y$) | Deposits Evaluation | Degree of Leuco Dye Formation | Remarks |
|---|---|---|---|---|---|---|---|---|
| 4-1 | EDTA-Fe 0.2 mol/l | none | 0 | 0 | 0.06 | D | −0.03 | Comp. |
| 4-2 | EDTA-Fe 0.12 mol/l | EDDS-Fe 0.08 mol/l | 0.75 | 0 | 0.04 | C | −0.03 | Comp. |
| 4-3 | EDTA-Fe 0.06 mol/l | EDDS-Fe 0.14 mol/l | 2.33 | 0 | 0.01 | A | −0.03 | Inv. |
| 4-4 | EDTA-Fe 0.035 mol/l | EDDS-Fe 0.165 mol/l | 4.71 | 0 | 0.01 | B | −0.02 | Inv. |
| 4-5 | EDTA-Fe 0.03 mol/l | EDDS-Fe 0.17 mol/l | 5.66 | 0 | 0.01 | C | −0.02 | Comp. |
| 4-6 | EDTA-Fe 0.2 mol/l | none | 0 | 30 | 0.05 | D | −0.02 | Comp. |
| 4-7 | EDTA-Fe 0.12 mol/l | EDDS-Fe 0.08 mol/l | 0.75 | 30 | 0.03 | C | −0.02 | Comp. |
| 4-8 | EDTA-Fe 0.06 mol/l | EDDS-Fe 0.14 mol/l | 2.33 | 30 | 0.01 | A | −0.02 | Inv. |
| 4-9 | EDTA-Fe 0.035 mol/l | EDDS-Fe 0.165 mol/l | 4.71 | 30 | 0.01 | B | −0.02 | Inv. |
| 4-10 | EDTA-Fe 0.03 mol/l | EDDS-Fe 0.17 mol/l | 5.66 | 30 | 0.01 | C | −0.02 | Comp. |
| 4-11 | EDTA-Fe 0.2 mol/l | none | 0 | 50 | 0.05 | C | −0.02 | Comp. |
| 4-12 | EDTA-Fe 0.12 mol/l | EDDS-Fe 0.08 mol/l | 0.75 | 50 | 0.02 | B | −0.02 | Comp. |
| 4-13 | EDTA-Fe 0.06 mol/l | EDDS-Fe 0.14 mol/l | 2.33 | 50 | 0.02 | A | −0.02 | Inv. |
| 4-14 | EDTA-Fe 0.035 mol/l | EDDS-Fe 0.165 mol/l | 4.71 | 50 | 0.01 | B | −0.02 | Inv. |
| 4-15 | EDTA-Fe 0.03 mol/l | EDDS-Fe 0.17 mol/l | 5.66 | 50 | 0.01 | B | −0.02 | Comp. |
| 4-16 | DTPA-Fe 0.2 mol/l | none | 0 | 0 | 0.25 | B | −0.21 | Comp. |
| 4-17 | DTPA-Fe 0.12 mol/l | EDDS-Fe 0.08 mol/l | 0.75 | 0 | 0.08 | A | −0.15 | Comp. |
| 4-18 | DTPA-Fe 0.06 mol/l | EDDS-Fe 0.14 mol/l | 2.33 | 0 | 0.01 | A | −0.05 | Inv. |
| 4-19 | DTPA-Fe 0.035 mol/l | EDDS-Fe 0.165 mol/l | 4.71 | 0 | 0.01 | B | −0.03 | Inv. |
| 4-20 | DTPA-Fe 0.03 mol/l | EDDS-Fe 0.17 mol/l | 5.66 | 0 | 0.01 | D | −0.03 | Comp. |
| 4-21 | DTPA-Fe 0.2 mol/l | none | 0 | 30 | 0.21 | B | −0.18 | Comp. |
| 4-22 | DTPA-Fe 0.12 mol/l | EDDS-Fe 0.08 mol/l | 0.75 | 30 | 0.07 | A | −0.04 | Comp. |
| 4-23 | DTPA-Fe 0.06 mol/l | EDDS-Fe 0.14 mol/l | 2.33 | 30 | 0.01 | A | −0.03 | Inv. |
| 4-24 | DTPA-Fe 0.035 mol/l | EDDS-Fe 0.165 mol/l | 4.71 | 30 | 0.01 | B | −0.04 | Inv. |
| 4-25 | DTPA-Fe 0.03 mol/l | EDDS-Fe 0.17 mol/l | 5.66 | 30 | 0.01 | D | −0.03 | Comp. |
| 4-26 | DTPA-Fe 0.2 mol/l | none | 0 | 50 | 0.15 | B | −0.13 | Comp. |
| 4-27 | DTPA-Fe 0.12 mol/l | EDDS-Fe 0.08 mol/l | 0.75 | 50 | 0.04 | A | −0.03 | Comp. |
| 4-28 | DTPA-Fe 0.06 mol/l | EDDS-Fe 0.14 mol/l | 2.33 | 50 | 0.01 | A | −0.03 | Inv. |
| 4-29 | DTPA-Fe 0.035 mol/l | EDDS-Fe 0.165 mol/l | 4.71 | 50 | 0.01 | B | −0.03 | Inv. |
| 4-30 | DTPA-Fe 0.03 mol/l | EDDS-Fe 0.17 mol/l | 5.66 | 50 | 0.01 | C | −0.03 | Comp. |

Comp.: Comparative Example
Inv.: Present Invention

As can clearly be seen from Table 4, in the present invention, when the ratio of ammonium ions to totals cations in the bleach-fixer was from 0 to 30 percent, the effects of the present invention was exhibited markedly.

Example 5

Tests were carried out in the same manner as Example 1, except that the concentration of sulfite ions in the bleach-fixer was varied as shown in Table 5.

Evaluation was carried out in the same manner as Example 3. Table 5 shows the results.

TABLE 5

| Test No. | Organic Acid Fe (III) Complex (B) | Organic Acid Fe (III) Complex (A) | A/B | Sulfite Ion Concentration (in mol/l) | Yellow Stains after Storage ($\Delta D_{min}Y$) | Deposits Evaluation | Degree of Leuco Dye Formation | Remarks |
|---|---|---|---|---|---|---|---|---|
| 5-1 | EDTA-Fe 0.2 mol/l | none | 0 | 0.02 | 0.15 | D | −0.03 | Comp. |
| 5-2 | EDTA-Fe 0.06 mol/l | EDDS-Fe 0.14 mol/l | 2.33 | 0.02 | 0.06 | C | −0.03 | Inv. |
| 5-3 | EDTA-Fe 0.03 mol/l | EDDS-Fe 0.17 mol/l | 5.66 | 0.02 | 0.06 | D | −0.02 | Comp. |
| 5-4 | EDTA-Fe 0.2 mol/l | none | 0 | 0.05 | 0.09 | D | −0.02 | Comp. |
| 5-5 | EDTA-Fe 0.06 mol/l | EDDS-Fe 0.14 mol/l | 2.33 | 0.05 | 0.03 | A | −0.02 | Inv. |
| 5-6 | EDTA-Fe 0.03 mol/l | EDDS-Fe 0.17 mol/l | 5.66 | 0.05 | 0.02 | C | −0.02 | Comp. |
| 5-7 | EDTA-Fe 0.2 mol/l | none | 0 | 0.5 | 0.06 | C | −0.02 | Comp. |
| 5-8 | EDTA-Fe 0.06 mol/l | EDDS-Fe 0.14 mol/l | 2.33 | 0.5 | 0.02 | A | −0.02 | Inv. |
| 5-9 | EDTA-Fe 0.03 mol/l | EDDS-Fe 0.17 mol/l | 5.66 | 0.5 | 0.01 | B | −0.02 | Comp. |
| 5-10 | EDTA-Fe 0.2 mol/l | none | 0 | 0.7 | 0.05 | C | −0.11 | Comp. |
| 5-11 | EDTA-Fe 0.06 mol/l | EDDS-Fe 0.14 mol/l | 2.33 | 0.7 | 0.02 | A | −0.08 | Inv. |
| 5-12 | EDTA-Fe 0.03 mol/l | EDDS-Fe 0.17 mol/l | 5.66 | 0.7 | 0.02 | B | −0.09 | Comp. |
| 5-13 | DTPA-Fe 0.2 mol/l | none | 0 | 0.02 | 0.39 | B | −0.21 | Comp. |
| 5-14 | DTPA-Fe 0.06 mol/l 1 | EDDS-Fe 0.14 mol/l | 2.33 | 0.02 | 0.11 | A | −0.05 | Inv. |
| 5-15 | DTPA-Fe 0.03 mol/l | EDDS-Fe 0.17 mol/l | 5.66 | 0.02 | 0.08 | D | −0.03 | Comp. |
| 5-16 | DTPA-Fe 0.2 mol/l | none | 0 | 0.05 | 0.29 | B | −0.18 | Comp. |
| 5-17 | DTPA-Fe 0.06 mol/l 1 | EDDS-Fe 0.14 mol/l | 2.33 | 0.05 | 0.04 | A | −0.03 | Inv. |
| 5-18 | DTPA-Fe 0.03 mol/l | EDDS-Fe 0.17 mol/l | 5.66 | 0.05 | 0.03 | D | −0.03 | Comp. |
| 5-19 | DTPA-Fe 0.2 mol/l | none | 0 | 0.5 | 0.25 | B | −0.21 | Comp. |
| 5-20 | DTPA-Fe 0.06 mol/l 1 | EDDS-Fe 0.14 mol/l | 2.33 | 0.5 | 0.02 | A | −0.05 | Inv. |
| 5-21 | DTPA-Fe 0.03 mol/l | EDDS-Fe 0.17 mol/l | 5.66 | 0.5 | 0.01 | C | −0.03 | Comp. |
| 5-22 | DTPA-Fe 0.2 mol/l | none | 0 | 0.7 | 0.2 | B | −0.36 | Comp. |
| 5-23 | DTPA-Fe 0.06 mol/l 1 | EDDS-Fe 0.14 mol/l | 2.33 | 0.7 | 0.01 | A | −0.16 | Inv. |
| 5-24 | DTPA-Fe 0.03 mol/l | EDDS-Fe 0.17 mol/l | 5.66 | 0.7 | 0.01 | C | −0.15 | Comp. |

Comp.: Comparative Example
Inv.: Present Invention

As can clearly be seen from Table 5, in the present invention, when the concentration of sulfite ions in the bleach-fixer was from 0.05 to 0.50 mol/liter, the formation of leuco dye was minimized in addition to the effects of the present invention.

Example 6

Tests were carried out in the same manner as Example 1, except that the replenishment rate of the bleach-fixer was varied to 80 ml/m$^2$ as well as 120 ml/m$^2$.

However, tests were carried out in such a manner that the concentration of each additive as well as the pH of the bleach-fixer replenisher was adjusted so that the composition of the bleach-fixer at the completion of running processing was the same as Example 1. Namely, tests were carried out so that the difference in the replenishment rate was only due to difference in the color developer component in the bleach-fixer and components eluted from the light-sensitive material.

Table 6 shows the results.

TABLE 6

| Test No. | Organic Acid Fe (III) Complex (B) | Organic Acid Fe (III) Complex (A) | A/B | Bleach-Fixer Replenishment Rate (in ml/m$^2$) | Yellow Stains after Storage ($\Delta D_{min}Y$) | Deposits Evaluation | Remarks |
|---|---|---|---|---|---|---|---|
| 6-1 | EDTA-Fe 0.2 mol/l | none | 0 | 55 | 0.06 | D | Comp. |
| 6-2 | EDTA-Fe 0.12 mol/l | EDDS-Fe 0.08 mol/l | 0.75 | 55 | 0.04 | C | Comp. |
| 6-3 | EDTA-Fe 0.06 mol/l | EDDS-Fe 0.14 mol/l | 2.33 | 55 | 0.01 | A | Inv. |
| 6-4 | EDTA-Fe 0.035 mol/l | EDDS-Fe 0.165 mol/l | 4.71 | 55 | 0.01 | B | Inv. |
| 6-5 | EDTA-Fe 0.03 mol/l | EDDS-Fe 0.17 mol/l | 5.66 | 55 | 0.01 | C | Comp. |
| 6-6 | EDTA-Fe 0.2 mol/l | none | 0 | 80 | 0.05 | D | Comp. |
| 6-7 | EDTA-Fe 0.12 mol/l | EDDS-Fe 0.08 mol/l | 0.75 | 80 | 0.04 | C | Comp. |
| 6-8 | EDTA-Fe 0.06 mol/l | EDDS-Fe 0.14 mol/l | 2.33 | 80 | 0.01 | A | Inv. |
| 6-9 | EDTA-Fe 0.035 mol/l | EDDS-Fe 0.165 mol/l | 4.71 | 80 | 0.01 | B | Inv. |
| 6-10 | EDTA-Fe 0.03 mol/l | EDDS-Fe 0.17 mol/l | 5.66 | 80 | 0.01 | C | Comp. |
| 6-11 | EDTA-Fe 0.2 mol/l | none | 0 | 120 | 0.03 | C | Comp. |
| 6-12 | EDTA-Fe 0.12 mol/l | EDDS-Fe 0.08 mol/l | 0.75 | 120 | 0.02 | B | Comp. |
| 6-13 | EDTA-Fe 0.06 mol/l | EDDS-Fe 0.14 mol/l | 2.33 | 120 | 0.01 | A | Inv. |
| 6-14 | EDTA-Fe 0.035 mol/l | EDDS-Fe 0.165 mol/l | 4.71 | 120 | 0.01 | B | Inv. |
| 6-15 | EDTA-Fe 0.03 mol/l | EDDS-Fe 0.17 mol/l | 5.66 | 120 | 0.01 | C | Comp. |
| 6-16 | DTPA-Fe 0.2 mol/l | none | 0 | 55 | 0.25 | B | Comp. |
| 6-17 | DTPA-Fe 0.12 mol/l | EDDS-Fe 0.08 mol/l | 0.75 | 55 | 0.08 | A | Comp. |
| 6-18 | DTPA-Fe 0.06 mol/l 1 | EDDS-Fe 0.14 mol/l | 2.33 | 55 | 0.01 | A | Inv. |
| 6-19 | DTPA-Fe 0.035 mol/l | EDDS-Fe 0.165 mol/l | 4.71 | 55 | 0.01 | B | Inv. |
| 6-20 | DTPA-Fe 0.03 mol/l | EDDS-Fe 0.17 mol/l | 5.66 | 55 | 0.01 | D | Comp. |
| 6-21 | DTPA-Fe 0.2 mol/l | none | 0 | 80 | 0.22 | B | Comp. |
| 6-22 | DTPA-Fe 0.12 mol/l | EDDS-Fe 0.08 mol/l | 0.75 | 80 | 0.07 | A | Comp. |
| 6-23 | DTPA-Fe 0.06 mol/l 1 | EDDS-Fe 0.14 mol/l | 2.33 | 80 | 0.01 | A | Inv. |
| 6-24 | DTPA-Fe 0.035 mol/l | EDDS-Fe 0.165 mol/l | 4.71 | 80 | 0.01 | B | Inv. |
| 6-25 | DTPA-Fe 0.03 mol/l | EDDS-Fe 0.17 mol/l | 5.66 | 80 | 0.01 | D | Comp. |
| 6-26 | DTPA-Fe 0.2 mol/l | none | 0 | 120 | 0.17 | B | Comp. |
| 6-27 | DTPA-Fe 0.12 mol/l | EDDS-Fe 0.08 mol/l | 0.75 | 120 | 0.04 | A | Comp. |
| 6-28 | DTPA-Fe 0.06 mol/l 1 | EDDS-Fe 0.14 mol/l | 2.33 | 120 | 0.01 | A | Inv. |
| 6-29 | DTPA-Fe 0.035 mol/l | EDDS-Fe 0.165 mol/l | 4.71 | 120 | 0.01 | B | Inv. |
| 6-30 | DTPA-Fe 0.03 mol/l | EDDS-Fe 0.17 mol/l | 5.66 | 120 | 0.01 | C | Comp. |

Comp.: Comparative Example
Inv.: Present Invention

As can clearly be seen from Table 6, in the present invention, when the replenishment rate of the bleach-fixer was less than or equal to 80 ml/m$^2$, the effects of the present invention were more pronounced.

What is claimed is:

1. A photographic bleach-fixing composition for a color photographic processing system in which bleach-fixing is carried out in a bleach-fixing bath which is replenished with a bleach-fixing replenishing solution, wherein the photographic bleach-fixing composition comprises:

(a) a Fe(III) complex of a compound represented by Formula (I);

Formula (I)

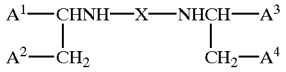

wherein each $A^1$, $A^2$, $A^3$ and $A^4$ represents independently —$CH_2OH$, —$PO_3M_2$ or —COOM, in which M represents a hydrogen atom or a monovalent cation; and X represents an alkylene group with 2 to 6 carbon atoms or —$(B^1O)_n$—$B_2$—, in which each $B^1$ and $B^2$ represents independently an alkylene group with 1 to 8 carbon atoms, and n represents an integer of 1 to 8, and (b) Fe(III) complex of ethylenediaminetetraacetic acid or Fe(III) complex of diethylenetriaminepentaacetic acid, provided that the mol concentration of (a) and (b) being A and B respectively satisfy the following formula:

$$0.9<A/B<5.0.$$

2. The photographic bleach-fixing composition of claim 1, further comprising an organic carboxylic acid.

3. The photographic bleach-fixing composition of claim 2, wherein the organic carboxylic acid is represented by Formula (C):

$$A_9\text{-}(COOM)_n \qquad \text{Formula (C)}$$

wherein n represents an integer of at least 2; $A_9$ represents a single bond or an organic group having 2 valences when n is 2, or $A_9$ represents an organic group having n valences when n is not less than 3; M represents a cation; and a plurality of M may be the same or different.

4. The photographic bleach-fixing composition of claim 1, wherein the photographic bleach-fixing composition comprises ammonium ions in a content of 0 to 30 mol % based on the total cation contained in the photographic bleach-fixing composition.

5. The photographic bleach-fixing composition of claim 1, wherein the photographic bleach-fixing composition comprises sulfite ions in an amount of 0.05 to 0.5 mol/l.

6. A method for processing a color photographic material using a bleach-fixing composition for a color photographic processing system in which bleach-fixing is carried out in a bleach-fixing bath which is replenished with a bleach-fixing replenishing solution, comprising the steps of:

developing the photographic material after being exposed;

bleach-fixing using the bleach-fixing composition;

adding a bleach-fixing replenishing solution to the bleach fixing bath in an amount of at most 80 ml per $m^2$ of the photographic material, and wherein the bleach-fixing composition and the bleach-fixing replenishing solution both comprise:

(a) a Fe(III) complex of a compound represented by Formula (I);

Formula (I)

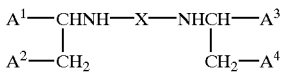

wherein each $A^1$, $A^2$, $A^3$ and $A^4$ represents independently —$CH_2OH$, —$PO_3M_2$ or —COOM, in which M represents a hydrogen atom or a monovalent cation; and X represents an alkylene group with 2 to 6 carbon atoms or —$(B^1O)_n$—$B^2$—, in which each $B^1$ and $B^2$ represents independently an alkylene group with 1 to 8 carbon atoms, and n represents an integer of 1 to 8, and (b) FE(III) complex of ethylenediaminetetraacetic acid or Fe (III) complex of diethylenetriaminepentaacetic acid, provided that the mol concentration of (a) and (b) being A and B respectively satisfy the following formula:

$$0.9<A/B<5.0.$$

7. The photographic bleach-fixing composition of claim 1, wherein the monovalent cation is selected from the group consisting of a sodium ion, a potassium ion, an ammonium ion, a methylammonium and trimethylammonium ion.

8. The photographic bleach-fixing composition of claim 1, wherein the compound represented by Formula (I) is selected from the group consisting of:

I-1

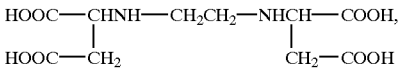

I-2

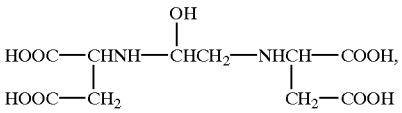

I-3

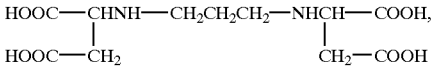

I-4

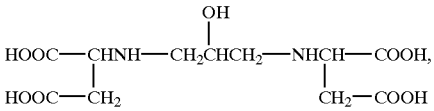

I-5

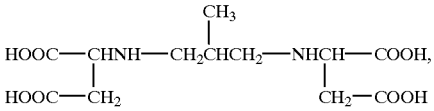

I-6

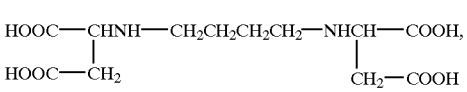

I-7

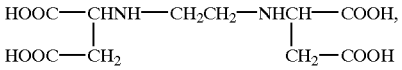

I-8

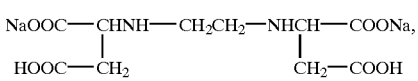

I-9

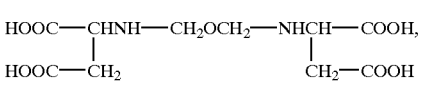

I-10

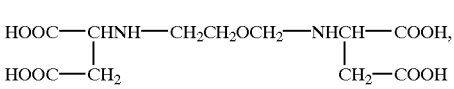

-continued
I-11
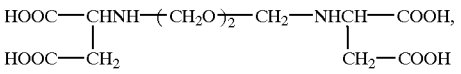
I-12
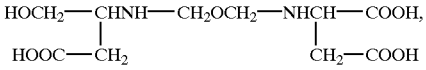
I-13
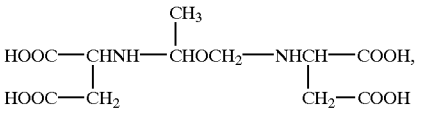
I-14
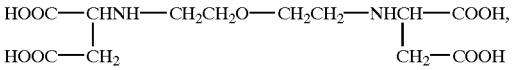
-continued
I-15
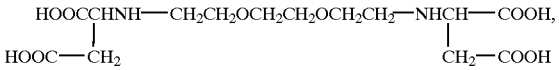
I-16
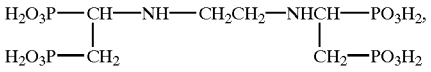
and
I-17
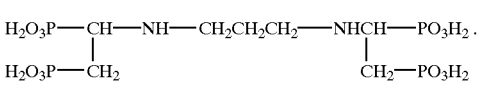
* * * * *